US012129551B2

(12) United States Patent
Freiderich et al.

(10) Patent No.: US 12,129,551 B2
(45) **Date of Patent: *Oct. 29, 2024**

(54) METHODS FOR ELECTROPOLISHING AND COATING ALUMINUM ON AIR AND/OR MOISTURE SENSITIVE SUBSTRATES

(71) Applicant: Consolidated Nuclear Security, LLC, Oak Ridge, TN (US)

(72) Inventors: John W. Freiderich, Oak Ridge, TN (US); Tasha L Boyd, Clinton, TN (US)

(73) Assignee: Consolidated Nuclear Security, LLC, Oak Ridge, TN (US)

( * ) Notice: Subject to any disclaimer, the term of this patent is extended or adjusted under 35 U.S.C. 154(b) by 53 days.

This patent is subject to a terminal disclaimer.

(21) Appl. No.: 17/895,148

(22) Filed: Aug. 25, 2022

(65) Prior Publication Data

US 2023/0017923 A1 Jan. 19, 2023

Related U.S. Application Data

(63) Continuation of application No. 17/379,395, filed on Jul. 19, 2021, now Pat. No. 11,459,658, which is a (Continued)

(51) Int. Cl.
*C23C 18/18* (2006.01)
*C23C 18/31* (2006.01)
(Continued)

(52) U.S. Cl.
CPC ..... *C23C 18/1848* (2013.01); *C23C 18/31* (2013.01); *C25D 3/44* (2013.01);
(Continued)

(58) Field of Classification Search
CPC ..... C25F 1/12; C25F 1/14; C25F 5/00; C25D 3/665
See application file for complete search history.

(56) References Cited

U.S. PATENT DOCUMENTS 2,446,331 A 8/1948 Hurley
2,446,349 A 8/1948 Wier, Jr.
(Continued)

FOREIGN PATENT DOCUMENTS

CN 104988547 A * 10/2015
CN 109234790 A * 1/2019
EP 3059335 A2 8/2016

OTHER PUBLICATIONS

Machine translation of CN109234790 of Ding et al (Year: 2019).*
(Continued)

*Primary Examiner* — Brian W Cohen
(74) *Attorney, Agent, or Firm* — Clements Bernard Walker; Christopher L. Bernard

(57) ABSTRACT

Methods for electropolishing and coating aluminum on a surface of an air and/or moisture sensitive substrate, including: in a vessel, submerging the substrate in a first molten salt bath and applying an anodizing current to the substrate at a first temperature to electropolish the surface of the substrate; wherein the first molten salt bath includes one of a first organic salt bath and first inorganic salt bath; wherein, when used, the first organic salt bath includes one of (a) aluminum halide and ionic liquid, (b) a combination of an aluminum halide and halogenatedmethylphenylsulfone ($C_6(H_{5-y}, X_y)SO_2CX_3$, where y is a number from 0-5), (c) a combination of an aluminum halide, an ionic liquid, and halogenatedmethylphenylsulfone ($C_6(H_{5-y}, X_y)SO_2CX_3$), and (d) $AlF_3$-organofluoride-hydrofluoric acid adduct; wherein, when used, the first inorganic salt bath includes aluminum halide and alkali metal halide; and wherein the anodizing current is 10-30 mA/cm$^2$.

22 Claims, 6 Drawing Sheets

Related U.S. Application Data continuation of application No. 16/572,810, filed on Sep. 17, 2019, now Pat. No. 11,142,841.

(51) Int. Cl.

| | |
|---|---|
| ***C25D 3/44*** | (2006.01) |
| ***C25D 3/66*** | (2006.01) |
| ***C25F 3/16*** | (2006.01) |
| ***C25F 3/22*** | (2006.01) |
| ***C25F 3/26*** | (2006.01) |
| ***C25F 3/28*** | (2006.01) |

(52) U.S. Cl.

CPC ..... *C25D 3/665* (2013.01); *C25F 3/16* (2013.01); *C25F 3/22* (2013.01); *C25F 3/26* (2013.01); *C25F 3/28* (2013.01)

(56) References Cited

U.S. PATENT DOCUMENTS

| | | | | |
|---|---|---|---|---|
| 2,446,350 | A | 8/1948 | Wier, Jr. | |
| 2,872,348 | A | 2/1959 | Eubank | |
| 3,048,497 | A * | 8/1962 | Moller | C23C 2/12 205/138 |
| 4,159,229 | A | 6/1979 | Donakowski et al. | |
| 4,265,726 | A | 5/1981 | Herrnring et al. | |
| 4,270,957 | A | 6/1981 | Donakowski et al. | |
| 4,379,030 | A | 4/1983 | Daenen et al. | |
| 4,417,954 | A | 11/1983 | Birkle et al. | |
| 4,571,291 | A | 2/1986 | Schell et al. | |
| 4,747,916 | A | 5/1988 | Kato et al. | |
| 4,904,355 | A | 2/1990 | Takahashi | |
| 4,966,659 | A | 10/1990 | Seto et al. | |
| 5,041,194 | A | 8/1991 | Mori et al. | |
| 5,141,615 | A | 8/1992 | Saeki et al. | |
| 6,065,876 | A | 5/2000 | Suhara et al. | |
| 6,143,364 | A | 11/2000 | Nakamori et al. | |
| 7,250,102 | B2 | 7/2007 | Fischer | |
| 9,771,661 | B2 | 9/2017 | Piascik et al. | |
| 9,903,034 | B2 | 2/2018 | Chen et al. | |
| 9,926,638 | B2 | 3/2018 | Inoue et al. | |
| 11,141,953 | B2 * | 10/2021 | Oh | C22F 1/002 |
| 2004/0023835 | A1 | 2/2004 | Chatfield | |
| 2012/0128968 | A1 | 5/2012 | Seddon et al. | |
| 2012/0189778 | A1 | 7/2012 | Riewe et al. | |
| 2013/0168258 | A1 | 7/2013 | Nakano et al. | |
| 2014/0272458 | A1 * | 9/2014 | Ruan | C22C 21/00 428/650 |
| 2015/0101935 | A1 | 4/2015 | Chen | |
| 2015/0322582 | A1 | 11/2015 | Freydina et al. | |
| 2016/0076161 | A1 | 3/2016 | Abbott | |
| 2017/0121835 | A1 | 5/2017 | Goto et al. | |
| 2018/0209057 | A1 * | 7/2018 | Tripathy | C25D 17/10 |

OTHER PUBLICATIONS

Machine translation of CN104988547 of Zhang et al (Year: 2015).*

Ueda, M., Overview over studies of electrodeposition of Al or Al alloys from low temperature chloroaluminate molten salts, Journal of Solid State State Electrochemistry 2017, 21(3), 641-647.

Jiang, Y.D. et al., Electrodepositing aluminum coating on uranium from aluminum chloride-1-ethyl-3-methylimidazolium chloride ionic liquid. Surface & Coatings Technology 2017, 309, pp. 980-985.

Gu, Y et al., Electrodeposition of alloys and compounds from high-temperature molten salts, Journal of Alloys and Compounds, vol. 690, 2017, pp. 228-238.

Jafarian, M. et al., Electrodeposition of Al, Mn, and Al—Mn Alloy on aluminum electrodes from molten salt (AlCl3—NaCl-KCl), Journal of Applied Electrochemistry,2009, vol. 39, Issue 8, pp. 1297-1303.

Ueda, M. et al., Co-deposition of Al—Cr—Ni alloys using constant potential and potential pulse techniques in AlCl3—NaCl—KCl molten salt, Electrochimica Acta, 2007 52(7):2515-2519.

Jafarian, M. et al., Electrodeposition of Aluminum from molten AlCl3—NaCl—KCl mixture. Journal of Applied Electrochemistry 2006, 36 (10), 1169-1173.

Grjotheim, K. et al., Some Problems Concerning Aluminum Electroplating in Molten Salts. Acts Chemica Scandinavica Series a-Physical and Inorganic Chemistry 1980, 34 (9), 666-670.

Phillips, J. et al., Aspects of Molybdenum Chemistry in the Basic NaCl/AlCl3 Melt at 175C. J Electrochem Soc 1977, 124 (10), 1465-1473.

* cited by examiner

METHODS FOR ELECTROPOLISHING AND COATING ALUMINUM ON AIR AND/OR MOISTURE SENSITIVE SUBSTRATES

CROSS-REFERENCE TO RELATED APPLICATIONS

The present disclosure is a continuation (CON) of co-pending U.S. patent application Ser. No. 17/379,395, filed on Jul. 19, 2021, and entitled "METHODS FOR ELECTROPOLISHING AND COATING ALUMINUM ON AIR AND/OR MOISTURE SENSITIVE SUBSTRATES," which is a continuation (CON) of U.S. patent application Ser. No. 16/572,810, filed on Sep. 17, 2019, now U.S. Pat. No. 11,142,841, and entitled "METHODS FOR ELECTROPOLISHING AND COATING ALUMINUM ON AIR AND/OR MOISTURE SENSITIVE SUBSTRATES," the contents of each of which are incorporated in full by reference herein.

STATEMENT REGARDING GOVERNMENT RIGHTS

The U.S. Government has certain rights to the present disclosure pursuant to Contract No. DE-NA0001942 between the U.S. Department of Energy and Consolidated Nuclear Security, LLC.

TECHNICAL FIELD

The present disclosure relates generally to the material science and chemistry fields. More specifically, the present disclosure relates to methods and systems for electropolishing and coating aluminum on air and/or moisture sensitive substrates for a variety of applications. These methods and systems utilize combinations of electropolishing, electroplating, electroless deposition, annealing, and hot dip techniques and technologies, as well as organic and inorganic salt baths.

BACKGROUND

Aluminum coatings may not be electrodeposited from aqueous media due to hydrogen generation. Instead, aluminum coatings have been electrodeposited from anhydrous liquids containing aluminum halides, volatile organic solvents, such as benzene or toluene, and ionic liquid components, such as imidazolium, piperidinium, pyridinium, or pyrrolidinium chloride, to create a low-temperature electrodeposition bath media. In addition, aluminum hydride dissolved in ether and aluminum alkoxides have been used to electrodeposit aluminum. These existing electrodeposition bath recipes are effective at electrodepositing aluminum on substrates that are not highly sensitive to air and/or moisture, such as steel or carbon. However, existing methods are not suitable for use with substrates that are highly sensitive to air and/or moisture, such as high strength magnesium alloys, nuclear fuel alloys, or other air and/or moisture sensitive materials. Heavily oxidizing surfaces and highly reducing substrates produce degraded carbon byproducts on their surfaces, undesirably trapping them in the subsequently electroplated coating. These types of highly-sensitive, reactive substrates require anaerobic and anhydrous environments for the electrodeposition of aluminum. These problems are fully addressed herein.

BRIEF SUMMARY OF THE DISCLOSURE

In various exemplary embodiments, the present disclosure provides methods and systems for electropolishing and coating aluminum on air and/or moisture sensitive substrates for a variety of applications. The methodologies provided herein are especially good for high-temperature, high-energy applications because impurities are excluded from the coating layer(s). These methods and systems utilize combinations of electropolishing, electroplating, electroless deposition, annealing, and hot dip techniques and technologies, as well as organic and inorganic salt baths. These organic salt baths generally include an aluminum halide with one of several general formulations including: (a) aluminum halide and ionic liquid (e.g., trihexyltetradecylphosphonium chloride ($P((CH_2)_5CH_3)_3(CH_2)_{13}CH_3Cl)$); (b) aluminum halide and halogenatedmethylphenylsulfone (e.g., $C_6(H_{5-y}, X_y)SO_2CX_3$, where y is a number from 0-5); (c) a combination of an aluminum halide, an ionic liquid (e.g., trihexyltetradecylphosphonium chloride ($P((CH_2)_5CH_3)_3(CH_2)_{13}CH_3Cl)$) and halogenatedmethylphenylsulfone ($C_6(H_{5-y}, X_y)SO_2CX_3$, where y is a number from 0-5); and (d) $AlF_3$-organofluoride-hydrofluoric acid adduct. The inorganic salt bath generally includes aluminum halide and alkali metal halide. An inert gas is preferably used with the salt and molten baths disclosed herein, and more particularly with the inorganic salt baths.

Thus, the methods and systems of the present disclosure use a combination of an electropolishing bath, electrodeposition and electroless deposition baths, and molten metal baths to provide a corrosion resistant aluminum coating on an air and/or moisture sensitive substrate. Additives such as KBr and/or KI can also be used for the leveling and brightening of the coatings. The methods and systems of the present disclosure eliminate electrolyte solutions that undesirably react with the underlying substrates, such as certain organic salts and solvents with ionizable hydrogen. The electropolishing processes disclosed herein clean oxides and other impurities from the substrate surface utilizing both the electropolishing bath chemistry composition and an applied working current. The set-up includes an electropolishing bath that absorbs impurities and prepares the substrate for one or more of the optional subsequent electroplating and/or electroless deposition of aluminum, a hot Al dip, and an aluminum annealing step. In a first configuration, the electropolishing bath, the electroplating bath, and substantial removal of the electrolyte and annealing of the coating are used. In a second configuration, the electropolishing bath, the electroplating bath, and removal of the electrolyte and annealing of the coating are used, followed by the hot Al dip bath. In a third configuration, the electropolishing bath step is directly followed by a hot Al dip. Thus, the following exemplary iterations are contemplated herein: (1) electropolish-electroless deposition, with or without annealing; (2) electropolish-electroless deposition-electroplating, with or without annealing; (3) electropolish-electroless deposition-electroplating-molten aluminum dip, with or without annealing; (4) electropolish-electroless deposition-molten aluminum dip, with or without annealing; and (5) electropolish-molten aluminum dip, with or without annealing.

The use of multiple distinct electrolyte systems is again contemplated herein: (1) an aluminum halide organic salt bath with one of several general formulations including: (a) aluminum halide and ionic liquid (e.g., trihexyltetradecylphosphonium chloride ($P((CH_2)_5CH_3)_3(CH_2)_{13}CH_3Cl)$); (b) aluminum halide and halogenatedmethylphenylsulfone ($C_6(H_{5-y}, X_y)SO_2CX_3$, where y is a number from 0-5)); (c) a combination of aluminum halide, ionic liquid (e.g., trihexyltetradecylphosphonium chloride ($P((CH_2)_5CH_3)_3(CH_2)_{13}CH_3Cl)$) and said halogenatedmethylphenylsulfone; and (d) $AlF_3$-organofluoride-hydrofluoric acid adduct, and (2) an inorganic salt bath including aluminum halide and alkali metal halides.

The aluminum organic halide salt may more specifically include, for example, a fluorinatedmethyphenylsulfone such as trifluoromethylphenylsulfone ($C_6(H_{5-y}, F_y)SO_2CF_3$) as a leveling agent/surfactant to produce the Al coatings. The inorganic salt bath may include, for example, $AlCl_3$—NaCl—KCl—(KBr, KI), typically 68-100% wt $AlCl_3$, 0-19% wt NaCl, and 0-13% KCl—(KBr, KI). Exemplary substrate materials here include zirconium, hafnium, thorium, uranium, plutonium, manganese, rare earth metals (La—Lu), yttrium, magnesium, lithium, and their alloys.

In a first exemplary embodiment, the present disclosure provides a method for electropolishing a surface of an air and/or moisture sensitive substrate, the method including: in a vessel, submerging the substrate in a first molten salt bath at a first temperature and applying an anodizing current to the substrate to electropolish the surface of the substrate; wherein the first molten salt bath includes one of a first organic salt bath and first inorganic salt bath; wherein, when used, the first organic salt bath includes one of (a) aluminum halide and ionic liquid (e.g., trihexyltetradecylphosphonium chloride ($P((CH_2)_5CH_3)_3(CH_2)_{13}CH_3Cl$); (b) a combination of an aluminum halide and a halogenatedmethylphenylsulfone such as fluorinatedmethylphenylsulfone ($C_6(H_{5-y}, F_y)SO_2CF_3$, where y is a number from 0-5); (c) a combination of an aluminum halide, an ionic liquid (e.g., trihexyltetradecylphosphonium chloride ($P((CH_2)_5CH_3)_3(CH_2)_{13}CH_3Cl$)), and a halogenatedmethylphenylsulfone such as fluorinatedmethylphenylsulfone ($C_6(H_{5-y}, F_y)SO_2CF_3$, where y is a number from 0-5); and (d) $AlF_3$-organofluoride-hydrofluoric acid adduct; wherein, when used, the first inorganic salt bath includes aluminum halide and alkali metal halide; and wherein the anodizing current is 10-30 mA/cm$^2$ applied using one of a reverse bias from a power supply coupled to the first molten salt bath and by swapping working and auxiliary electrode leads coupled to the first molten salt bath. Optionally, when used, the first organic salt bath includes (a) 55-67 wt % $AlCl_3$ and 33-45 wt % halogenatedmethylphenylsulfone. Optionally, when used, the first organic salt bath includes (b) 55-67 wt % $AlCl_3$, 0.1-10 wt % ionic liquid, and 27-44.9 wt % halogenatedmethylphenylsulfone. When optional first organic salt bath composition (a) or (b) preceding is used, the first temperature of the salt bath is preferably below the salt bath's flash point. Optionally, when used, the first organic salt bath includes (c) 60-70 wt % aluminum fluoride, 23-29 wt % 1-ethyl-3-methylimidazolium fluoride, and 8-10 wt % hydrofluoric acid and the first temperature of the salt bath is preferably 20-70 degrees C. Optionally, when used, the first inorganic salt bath includes (i) 68-100 wt % $AlCl_3$, 0-19 wt % NaCl, and 0-13 wt % KCl. Optionally, when used, the first inorganic salt bath includes (ii) 82 wt % $AlCl_3$, 11 wt % NaCl, and 7 wt % KCl. Optionally, when used, the first inorganic salt bath includes (iii) 75-100 wt % $AlBr_3$, 0-15.4 wt % NaBr, and 0-9.6 wt % KBr. When optional first inorganic salt bath composition (i) or (ii) preceding is used, the first temperature of the inorganic salt bath is preferably 95-250 degrees C. When optional first inorganic salt bath composition (iii) preceding (i.e., with Br) is used, the first temperature of the inorganic salt bath is preferably 95-250 degrees C. and more preferably 110-250 degrees C. Optionally, when used, the first inorganic salt bath includes (iv) 76-100 wt % $AlI_3$, 0-15 wt % NaI, and 0-9 wt % KI and the first temperature of the first inorganic salt bath is preferably 110-250 degrees C. and more preferably 120-250 degrees C.

Optionally, the method of this first exemplary embodiment further includes, subsequent to electropolishing the surface of the substrate, coating the electropolished surface of the substrate with aluminum. Optionally, coating the electropolished surface of the substrate with aluminum includes: discontinuing the anodizing current and allowing the electropolished substrate to dwell in the first molten salt bath such that the electropolished surface of the substrate is coated with aluminum. Optionally, coating the electropolished surface of the substrate with aluminum includes: one or more of heating the first molten salt bath and evaporating the first molten salt bath under vacuum to remove the first molten salt bath from the vessel, physically pumping the first molten salt bath from the vessel, and draining the first molten salt bath from the vessel; and, in the vessel, submerging the electropolished substrate in a second molten salt bath at a second temperature such that the electropolished surface of the substrate is coated with aluminum; wherein the second molten salt bath includes one of a second organic salt bath and second inorganic salt bath; wherein, when used, the second organic salt bath includes one of (a) aluminum halide and ionic liquid (e.g., trihexyltetradecylphosphonium chloride ($P((CH_2)_5CH_3)_3(CH_2)_{13}CH_3Cl$); (b) a combination of an aluminum halide and halogenatedmethylphenylsulfone; (c) a combination of an aluminum halide, an ionic liquid (e.g., trihexyltetradecylphosphonium chloride ($P((CH_2)_5CH_3)_3(CH_2)_{13}CH_3Cl$)), and halogenatedmethylphenylsulfone; and (d) $AlF_3$-organofluoride-hydrofluoric acid adduct; and wherein, when used, the second inorganic salt bath includes aluminum halide and alkali metal halide. Preferably, the halogenatedmethylphenylsulfone comprises fluorinatedmethylphenylsulfone ($C_6(H_{5-y}, F_y)SO_2CF_3$, where y is a number from 0-5). Optionally, the method further includes purging the vessel with an inert gas after the first molten salt bath is removed from the vessel. The inert gas suppresses the formation of aluminum oxychloride species, which tend to impact coating brightness. Optionally, the second temperature is below a flash point of the second organic salt bath, when used, and 95-250 degrees C. for the second inorganic salt bath when fluoride is not used in the inorganic salt bath but 95-800 degrees C. when fluoride is used. Optionally, the second inorganic salt bath includes 68-100 wt % $AlCl_3$, 0-19 wt % NaCl, and 0-13 wt % KCl with optional brighteners KBr and/or KI. Optionally, coating the electropolished surface of the substrate with aluminum further includes: applying a reducing current to the electropolished substrate to coat the surface of the electropolished substrate with aluminum derived from the first molten salt bath. Optionally, the reducing current is not more than 7 mA/cm$^2$, is alternating-current frequency modulated, and is applied using a working electrode coupled to the first molten salt bath. Optionally, coating the electropolished surface of the substrate with aluminum further includes: applying a reducing current to the electropolished substrate to coat the surface of the electropolished substrate with aluminum derived from the second molten salt bath. Optionally, the reducing current is not more than 7 mA/cm$^2$, is alternating-current frequency modulated, and is applied in the second molten salt bath. Optionally, the method further includes adding a transition metal halide to the second molten salt bath to cause an aluminum alloy to be coated on the surface of the electropolished substrate. Optionally, the transition metal halide includes one or more of Mn, Cr, and Ni. Optionally, the method further includes annealing a resulting aluminum coating. Optionally, coating the electropolished surface of the substrate with aluminum includes: in the vessel, submerging the substrate in a molten pool of aluminum at a temperature of 660 degrees C. or more to coat the surface of the substrate with aluminum or to coat the surface of an aluminum-coated substrate with additional aluminum. It will be readily apparent to those of ordinary skill in the art that any or all of the above steps can be utilized in any combination and can be iterated as desired.

In another exemplary embodiment, the present disclosure provides a method for coating aluminum on a surface of an air and/or moisture sensitive substrate, the method including: in a vessel, submerging the substrate in a molten salt bath with a temperature of at least 95 degrees C.; applying an anodizing current to the substrate to electropolish the surface of the substrate; and coating the electropolished surface of the substrate with aluminum by one of submerging the substrate in a molten pool of aluminum at a temperature of 660 degrees C. or more, discontinuing the anodizing current and allowing the electropolished substrate to dwell in the molten salt bath at a temperature of at least 95 degrees C. such that the electropolished surface of the substrate is electrolessly coated with aluminum, and applying a reducing current to the electropolished substrate to electroplate the surface of the electropolished substrate with aluminum derived from the molten salt bath, wherein the reducing current is no more than 7 $mA/cm^2$; wherein the molten salt bath includes aluminum halide and alkali metal halide. Optionally, the substrate includes one or more of zirconium, hafnium, thorium, uranium, plutonium, manganese, a rare earth metal (La—Lu), yttrium, magnesium, lithium, and their alloys. Optionally, the vessel is sealed and contains an inert cover gas. Optionally, the substrate electrolessly coated with aluminum is submerged in a molten pool of aluminum at a temperature of at least 660 degrees C. Optionally, the substrate electroplated with aluminum is submerged in a molten pool of aluminum at a temperature of at least 660 degrees C. It will be readily apparent to those of ordinary skill in the art that any or all of the above steps can be utilized in any combination and can be iterated as desired.

BRIEF DESCRIPTION OF THE DRAWINGS

The present disclosure is illustrated and described herein with reference to the various drawings, in which like reference numbers are used to denote like method steps/system components, as appropriate, and in which.

DESCRIPTION OF EMBODIMENTS

Figure 1:
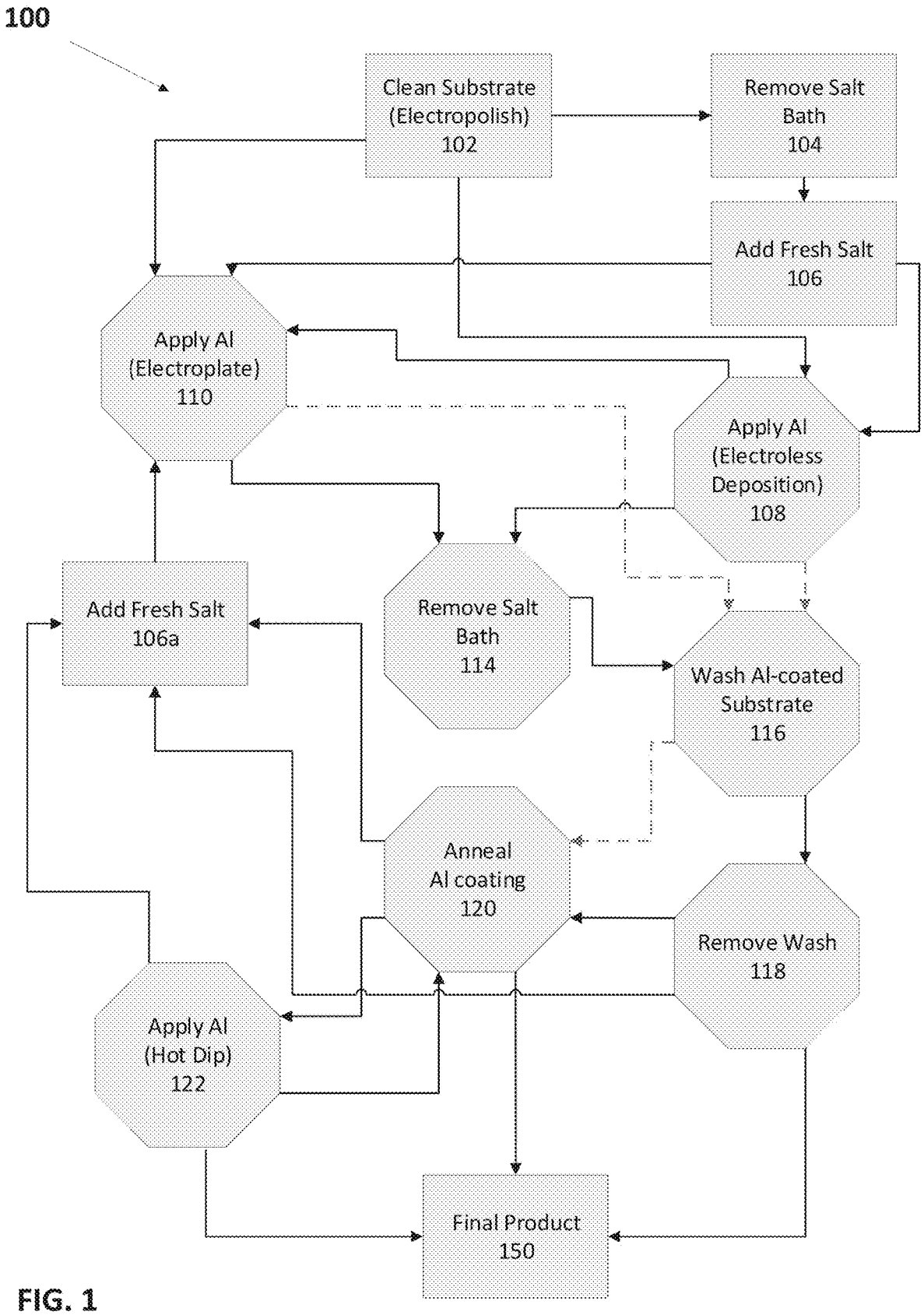
FIG. 1 is a flowchart illustrating one exemplary embodiment of the electropolishing-coating method of the present disclosure, where the solid lines depict process steps using either an organic or inorganic salt bath, and where the three dashed lines depict process steps using more likely an organic salt bath and less likely an inorganic salt bath due to special process conditions required for an inorganic salt bath.

Again, in various exemplary embodiments, the present disclosure provides methods and systems for coating aluminum on air and/or moisture sensitive substrates for a variety of applications. These methods and systems utilize combinations of electropolishing, electroplating, electroless deposition, annealing, and hot dip techniques and technologies, as well as organic and inorganic salt baths. These organic salt baths generally include an aluminum halide organic salt bath with one of several general formulations including: (a) aluminum halide and ionic liquid (e.g., trihexyltetradecylphosphonium chloride ($P((CH_2)_5CH_3)_3(CH_2)_{13}CH_3Cl)$); (b) aluminum halide and halogenatedmethylphenylsulfone ($C_6(H_{5-y},X_y)SO_2CX_3$, where y is a number from 0-5); (c) a combination of an aluminum halide, an ionic liquid (e.g., trihexyltetradecylphosphonium chloride ($P((CH_2)_5CH_3)_3(CH_2)_{13}CH_3Cl)$) and halogenatedmethylphenylsulfone ($C_6(H_{5-y},X_y)SO_2CX_3$, where y is a number from 0-5)); and (d) $AlF_3$-organofluoride-hydrofluoric acid adduct. Preferably, the halogenatedmethylphenylsulfone comprises fluorinatedmethylphenylsulfone ($C_6(H_{5-y},F_y)SO_2CF_3$). The inorganic salt bath generally includes aluminum halide and alkali metal halide.

Thus, again, the methods and systems of the present disclosure use a combination of an electropolishing bath, electrodeposition and electroless deposition baths, and molten metal baths to provide a corrosion resistant aluminum coating on an air and/or moisture sensitive substrate. Additives such as KBr or KI can also be used for the leveling and brightening of the coatings. The methods and systems of the present disclosure eliminate electrolyte solutions that undesirably react with the underlying substrates, such as certain organic salts and solvents with ionizable hydrogen. The electropolishing processes disclosed herein clean oxides and other impurities from the substrate surface utilizing both the electropolishing bath chemistry composition and an applied working current. The set-up includes an electropolishing bath that absorbs impurities and prepares the substrate for one or more of the optional subsequent electroplating and/or electroless deposition of aluminum, a hot Al dip, and an aluminum annealing step. In a first configuration, the electropolishing bath, the plating bath, and substantial removal of the electrolyte and annealing of the coating are used. In a second configuration, the electropolishing bath, the plating bath, and removal of the electrolyte and annealing of the coating are used, followed by the hot dip bath. In a third configuration, the electropolishing bath step is directly followed by a hot dip bath. Thus, the following exemplary iterations are contemplated herein: (1) electropolish-electroless deposition; (2) electropolish-electroless deposition-electroplating; (3) electropolish-electroless deposition-electroplating-molten aluminum dip; (4) electropolish-electroless deposition-molten aluminum dip; and (5) electropolish-molten aluminum dip. Each of the exemplary iterations may be done with or without annealing. The use of multiple distinct electrolyte systems is again contemplated herein: (1) an aluminum halide organic salt bath with one of several general formulations including: (a) aluminum halide and ionic liquid (e.g., trihexyltetradecylphosphonium chloride ($P((CH_2)_5CH_3)_3(CH_2)_{13}CH_3Cl)$); (b) aluminum halide, halogenatedmethylphenylsulfone ($C_6(H_{5-y},X_y)SO_2CX_3$, where y is a number from 0-5); (c) a combination of aluminum halide, ionic liquid (e.g., trihexyltetradecylphosphonium chloride ($P((CH_2)_5CH_3)_3(CH_2)_{13}CH_3Cl)$)) and said halogenatedmethylphenylsulfone; and (d) $AlF_3$-organofluoride-hydrofluoric acid adduct, and (2) an inorganic salt bath including aluminum halide and alkali metal halides. The aluminum organic halide salt may more specifically include, for example, trifluoromethylphenylsulfone ($C_6(H_{5-y},F_y)SO_2CF_3$) as a leveling agent/surfactant to produce the Al coatings. The inorganic salt bath may include, for example, $AlCl_3$—NaCl—KCl—(KBr, KI), typically (i) 68-100% wt $AlCl_3$, 0-19% wt NaCl, and 0-13% KCl—(KBr, KI) or (ii) 82 wt % $AlCl_3$, 11 wt % NaCl, and 7 wt % KCl—(KBr,KI). Additionally, the alkali metal halide may include bromine or iodine, such that when used, the first inorganic salt bath may include (iii) 75-100 wt % $AlBr_3$, 0-15.4 wt % NaBr, and 0-9.6 wt % KBr or (iv) 76-100 wt % $AlI_3$, 0-15 wt % NaI, and 0-9 wt % KI. Exemplary substrate materials here include zirconium, hafnium, thorium, uranium, plutonium, manganese, rare earth metals (La—Lu), yttrium, magnesium, lithium, and their alloys.

FIG. 1 is a flowchart illustrating one exemplary embodiment of the electropolishing-coating method 100 of the present disclosure, utilizing an organic or inorganic salt bath. Although the specifics are described in greater detail herein below, the method generally begins by electropolishing the substrate in an organic or inorganic salt bath disposed in a vessel 102. Again, this salt bath may include an aluminum halide organic salt bath with one of several general formulations including: (a) $AlCl_3$-ionic liquid (e.g., trihexyltetradecylphosphonium chloride ($P((CH_2)_5CH_3)_3(CH_2)_{13}CH_3Cl$); (b) $AlCl_3$-halogenatedmethylphenylsulfone ($C_6(H_{5-y},X_y)SO_2CX_3$, where y is a number from 0-5); (c) a combination of $AlCl_3$-ionic liquid (e.g., trihexyltetradecylphosphonium chloride ($P((CH_2)_5CH_3)_3(CH_2)_{13}CH_3Cl$)) and $AlCl_3$-halogenatedmethylphenylsulfone ($C_6(H_{5-y},X_y)SO_2CX_3$, where y is a number from 0-5); and (d) $AlF_3$-organofluoride-hydrofluoric acid adduct, or an inorganic salt bath including aluminum halide and alkali metal halides, such as $AlCl_3$—NaCl—KCl—(KBr, KI). The first salt bath can then be removed 104 and a fresh (second) organic or inorganic salt bath added to the vessel 106. Subject to the limitations on the use of organic salt baths depicted by the dashed-dotted pathways in FIG. 2, the chemical composition of the fresh salt bath can be any of the various chemical compositions disclosed herein used in the first salt bath. For example, an inorganic first salt bath using a chloroaluminate molten salt may use a bromoaluminate molten salt in the second salt bath or even an organic second salt bath such as $AlCl_3$-halogenatedmethylphenylsulfone. However, as a practical matter due to time and cost constraints, the composition of the first and subsequent salt baths will generally be identical. The subsequent salt bath can then be used to perform electroless Al deposition on the electropolished substrate 108 or Al electroplating on the electropolished substrate 110. It will also be appreciated that, after electropolishing 102, the original (first) salt bath can be used to perform the electroless Al deposition on the electropolished substrate 108 or Al electroplating on the electropolished substrate 110, without first changing the salt bath 104,106. Further, Al electroplating on the electropolished substrate 110 can be performed after electroless Al deposition on the electropolished substrate 108 in the same salt bath, whether original or subsequent. In any event, the salt bath, original or subsequent, is then removed 114, the Al-coated substrate is then washed 116, and the wash is removed from the vessel 118. At this point, the Al-coated substrate may be considered the final product 150. Alternatively, the Al coating may be annealed 120, optionally to form the final product 150. Alternatively, another subsequent (third or more) salt bath can be added to the vessel 106*a* and Al electroplating of the annealed Al-coated substrate repeated 110 and so on, or the annealed Al-coated substrate can be hot dipped in Al 122 one or more times to form the final product 150. Again, the specifics of each of these steps are described in greater detail herein below.

Figure 2:
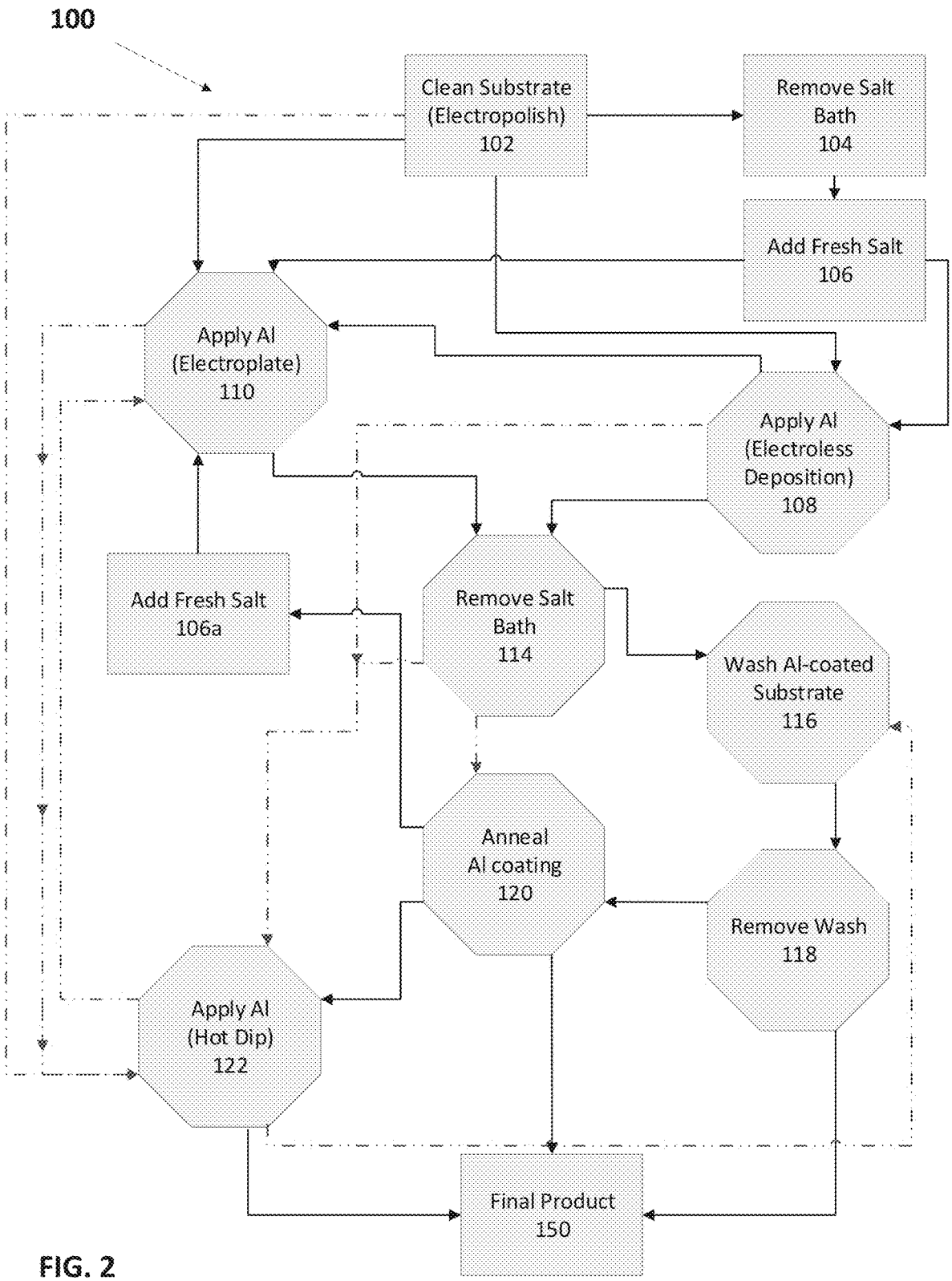
FIG. 2 is a flowchart illustrating a further exemplary embodiment of the electropolishing-coating method of the present disclosure, where the dashed-dotted line pathways added to FIG. 1 depict process steps utilizing only an inorganic salt bath.
Figure 3:
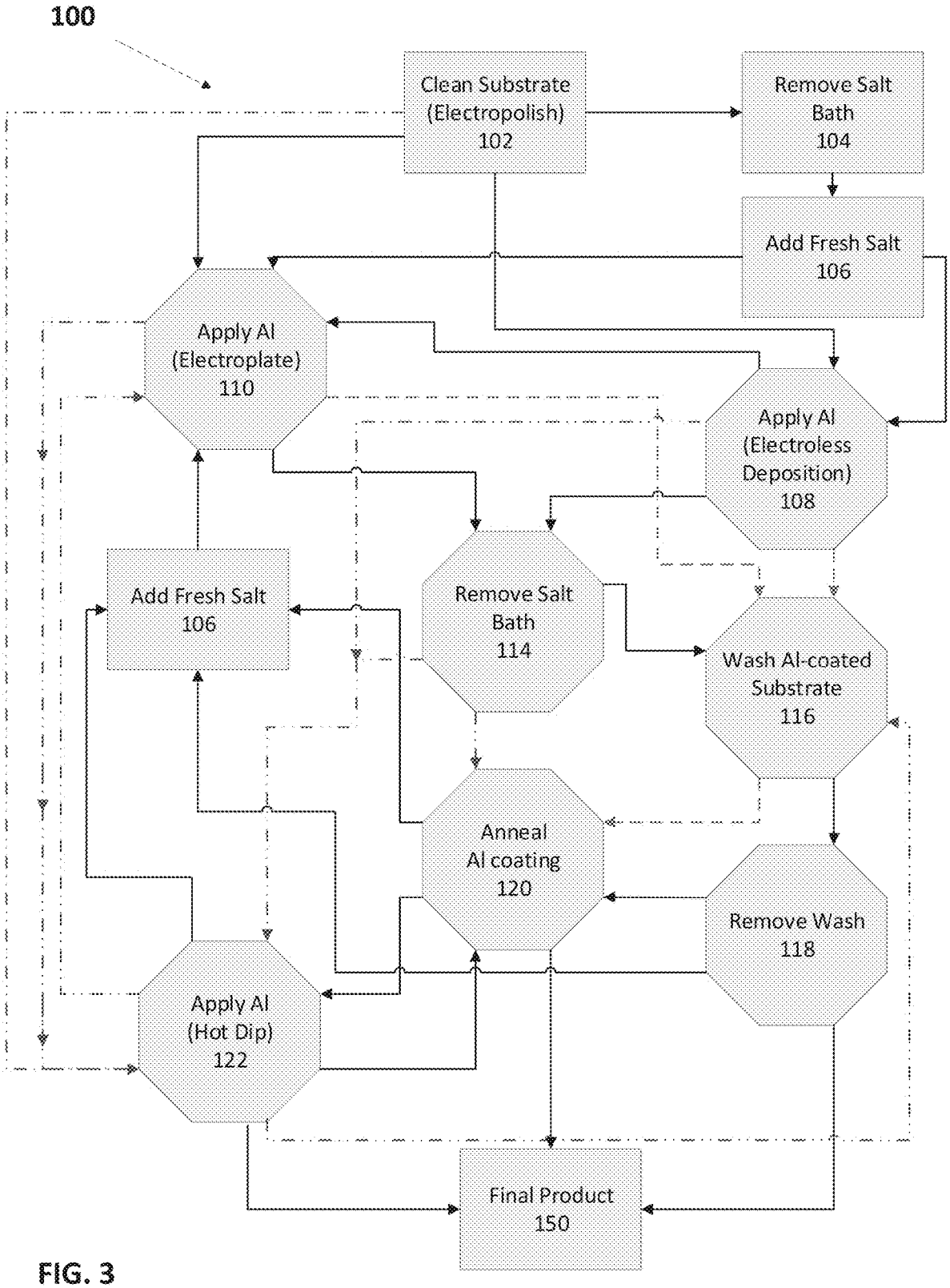
FIG. 3 is a flowchart illustrating the compilation of all methods described for FIGS. 1 and 2.

FIG. 2 is a flowchart illustrating a further exemplary embodiment of the electropolishing-coating method 100 of the present disclosure, where the dashed-dotted pathways overlaid upon FIG. 1 depict process steps that can be taken only when utilizing an inorganic salt bath. Here, after electroless Al deposition has been performed in the inorganic salt bath 108, original or subsequent, and optionally after the salt bath has been removed from the vessel 114, the Al hot dip 122 may be performed to form the final product 150 or otherwise. The Al hot dip 122 may also be performed directly after the original electropolishing step 102 or directly after electroplating 110. In the event that the Al hot dip 122 does not immediately result in the desired final product 150, the Al hot dipped substrate 122, optionally also annealed 120, can be fed into the above-described Al electroplating loop 110 or into the wash 116, wash removal 118, and annealing 120 loop. Again, the specifics of each of these steps are described in greater detail herein below.

Figure 4:
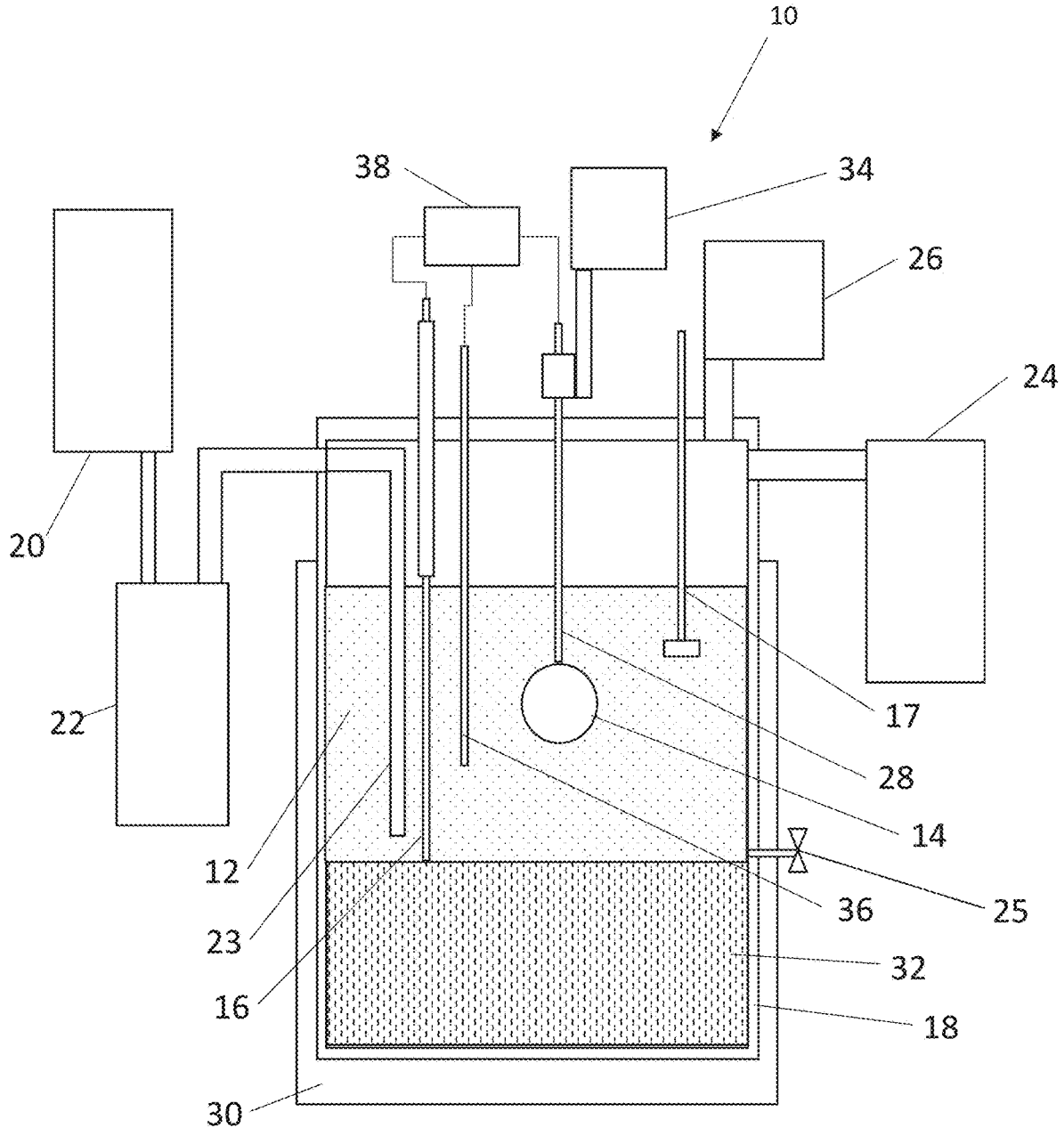
FIG. 4 is a schematic diagram illustrating one exemplary embodiment of the Al coating bath set-up of the present disclosure.
Figure 5:
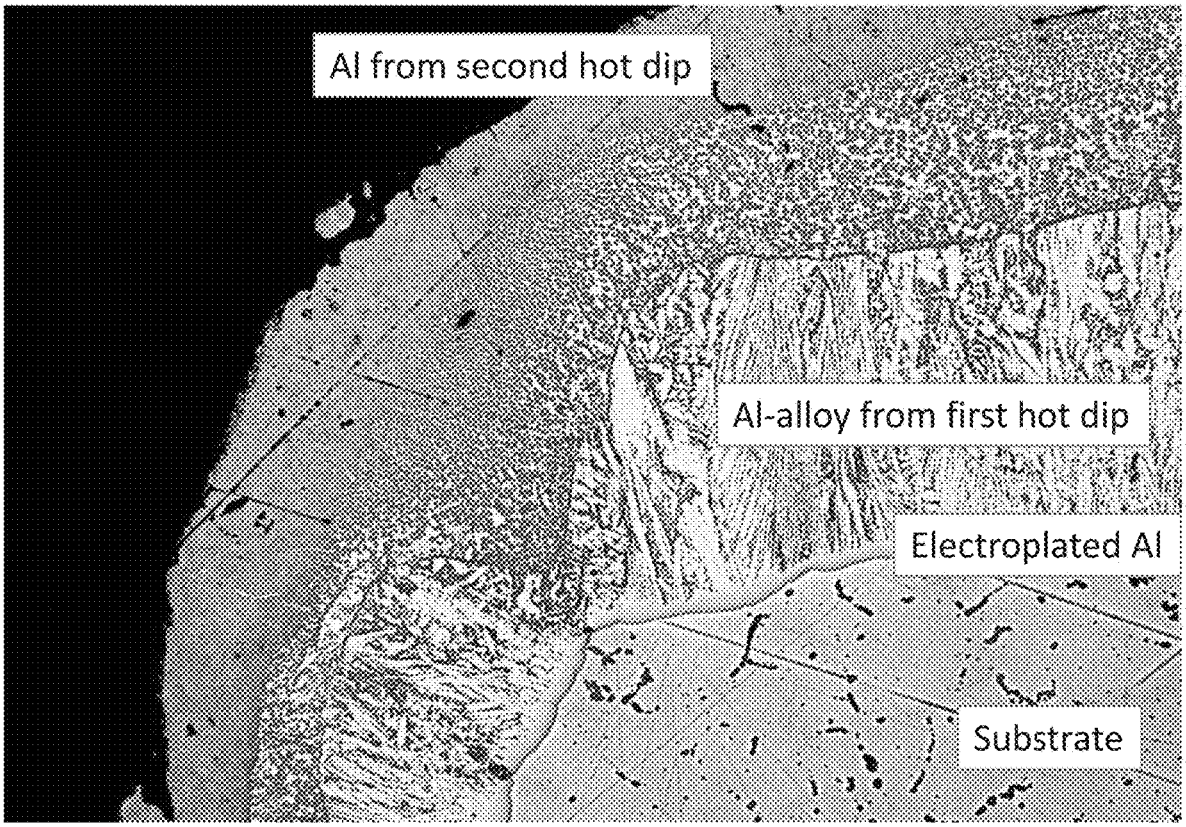
FIG. 5 is a microscopy image of an Al deposit after electropolishing, Al electroplating, annealing (not identifiable on the image), and two molten Al dips in accordance with the methods provided herein.
Figure 6:
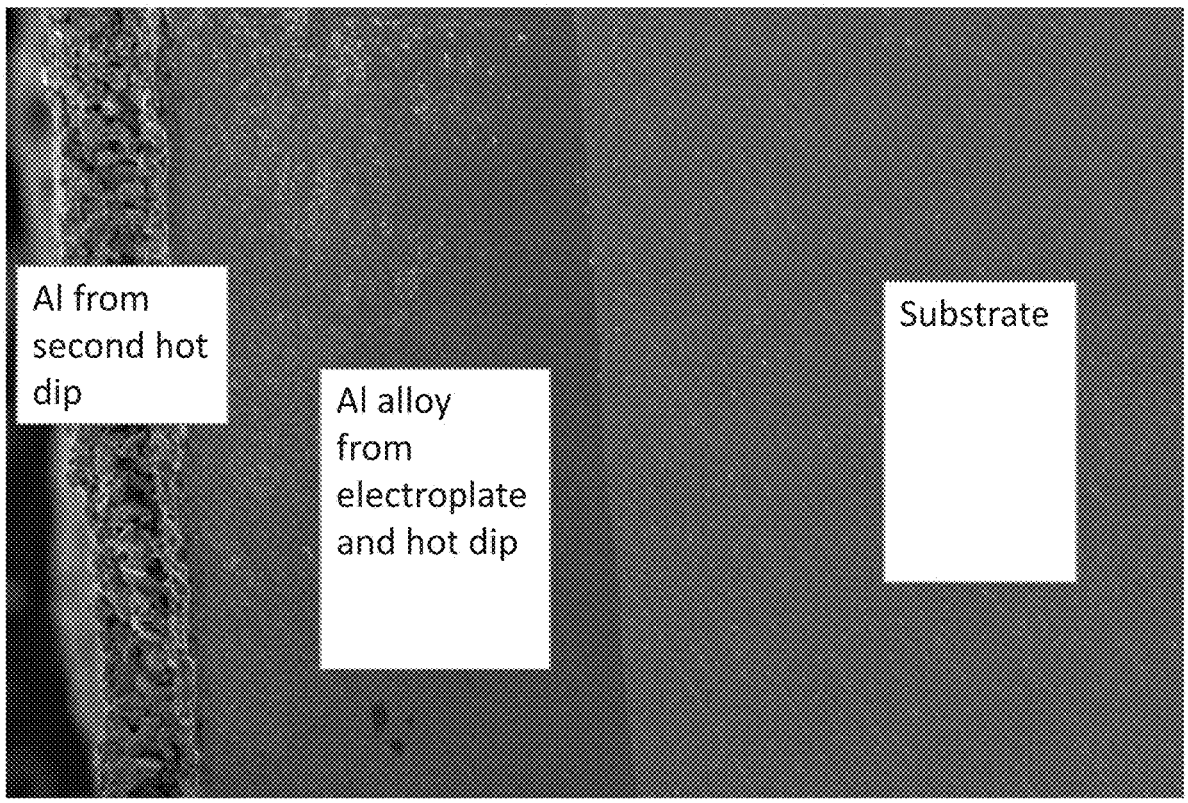
FIG. 6 is a scanning electron microscopy (SEM) image of an Al deposit after electropolishing, Al electroplating, and two molten Al dips in accordance with the methods provided herein.

Referring now specifically to FIG. 4, in one exemplary embodiment using the Al coating set-up 10, the surface of the substrate 14 is cleaned or electropolished by submerging the substrate 14 in the molten salt bath 12 containing, for example, 67-80 wt % $AlCl_3$, 12-19 wt % NaCl, 8-14 wt % KCl, and an aluminum auxiliary electrode 16. An anodizing current of 10-30 $mA/cm^2$ is applied to the substrate 14 to electropolish the surface of the substrate 14 and clean and prepare it for aluminum electrodeposition, electroless deposition, etc. During this time, agitation of the salt bath 12 is typically performed using a mechanical or ultrasonic agitator 17 or the like. In addition, or alternatively, the substrate 14 may be rotated to induce forced convection in lieu of mechanical or ultrasonic agitation, or a thermal differential may be applied to the vessel 18 to induce a thermal gradient and provide convection. Once the substrate 14 maintains a predetermined output potential (e.g., a steady-state potential response) indicating that the substrate 14 is free of surface oxides, the substrate 14 is considered to be clean and the cleaning step ceases. This step is performed at about 95-250 degrees C. Optionally, the electropolished substrate 14 is then allowed to electrolessly dwell in the molten salt bath 12 to allow deposition of aluminum for less than about 10 minutes, for example. Alternatively, the gas tight sealed vessel 18 is heated to about 95-600 degrees C. using a coupled furnace 30 and a vacuum is pulled on the vessel 18 using a vacuum pump 20 to evaporate the $AlCl_3$ component of the salt bath 12 into a cold condenser 22. Alternatively, the vacuum pump 20 and cold condenser 22 may be coupled to a conduit 23 that physically transports the salt bath 12 out of the vessel 18 at about 95-600 degrees C. A drain pipe 25 may also be used for salt bath 12 removal. After sufficient removal of the salt bath 12, the vacuum pump 20 is then stopped and an inert gas supply 24, such as argon or helium, is used to backfill the vessel 18 to ambient pressure. The vessel 18 is cooled back to about 95-250 degrees C., if applicable, and a salt powder feeder 26 drops a fresh batch of salt bath 12 into the vessel 18 with a composition of 67-80 wt % $AlCl_3$, 8-17 wt % NaCl, 8-12 wt % KCl, and 4 wt % KBr (or KI, as both act as brighteners), for example. This fresh salt mixture 12 becomes molten and a reducing current of no more than 7 mA/cm$^2$, which may be AC frequency modulated, is applied at the working electrode 28 and substrate 14 until a desired coating thickness of aluminum 32 from the salt bath 12 is obtained. Again, during this time, agitation of the salt bath 12 is typically performed using the mechanical or ultrasonic agitator 17 or the like. Agitation of the salt bath 12 is preferred, but may not be necessary in all electrodeposition cases. In addition, or alternatively, the substrate 14 may be rotated to induce forced convection in lieu of mechanical or ultrasonic agitation or a thermal differential may be applied to the vessel 18 to induce a thermal gradient and provide convection. The Al coating may be annealed at 160-535 degrees C. for 2-4 hours and cooled at a rate of less than 100 degrees C. per hour. If the plated aluminum from the electroplating bath is not sufficient to meet a desired specification or quality, the substrate 14 may then be submerged in a molten pool of aluminum metal 32 for additional Al coating. This additional step requires heating the vessel 18 to at least the melting point of aluminum (660 degrees C. at atmospheric pressure) to liquefy the aluminum block 32 disposed at the bottom of the vessel 18. During this additional step, the substrate 14, which will need to be resistant to the stresses of high temperatures, is submerged in the molten Al metal pool at about 700-890 degrees C. for a short amount of time (e.g., between about 5 and 30 seconds). The substrate 14 is then slowly removed from the Al using a hoist system 34 and desirably suspended above the Al for several seconds to allow for slow cooling of the Al coating, and then placed on a heat tolerant surface to continue cooling. The hoist system 34 includes a means for securing the substrate 14 during lowering and raising the substrate into and out from the molten salt and aluminum baths such that the means has a melting temperature higher than the melting temperature of the molten aluminum bath and is composed of material non-reactive with the molten salt and aluminum baths, such as a reinforced ceramic, either alumina or magnesia, or barium zirconate-coated steel. The use of a slow cooling rate ensures a high-quality coating that is free of stress cracking. The surface of the substrate 14 may then be machined for quality, if desired. It should be noted that the various electrodes 16,28 and a reference electrode 36 are all coupled to an appropriate potentiostat/power supply 38. Special attention is given to the leaching of the substrate 14 into the liquid aluminum coating applied during the metal dip step. Depending on the thickness, formation of alloys/intermetallics, coefficient of thermal expansion, and structural stress properties, the dip time may be shorter or longer. There is benefit to performing two hot dips. The substrate 14 first is hot dipped for a predetermined amount of time, allowed to cool to less than about 660 degrees C., and then hot dipped again for a shorter period of time to preserve the first hot dip. As shown in FIGS. 5 and 6, the first Al hot dip allows for the formation of alloys/intermetallics with the substrate 14, and the second hot dip provides a pure Al outer coating for robust corrosion resistance. The chemical composition of the substrate will determine the intermittent cooling temperature between the first and second dips and the residence times of the substrate 14 in each dip.

Referring again specifically to FIG. 4, in another exemplary embodiment using the Al coating set-up 10 of the present disclosure, the surface of a substrate 14 is cleaned by submerging the substrate 14 in a molten salt bath 12 containing, for example, 67-80 wt % $AlCl_3$, 12-19 wt % NaCl, 8-14 wt % KCl, and an aluminum auxiliary electrode 16. An anodizing current of 10-30 mA/cm$^2$ is applied to the substrate 14 to electropolish the surface and clean and prepare it for aluminum electrodeposition. Once the substrate 14 maintains a predetermined steady-state potential response, the substrate 14 is considered to be clean and the cleaning step ceases. This cleaning step is performed at about 95-250 degrees C. Next, the gas tight sealed vessel 18 is heated to about 95-600 degrees C. using a coupled furnace 30 and a vacuum is pulled on the vessel 18 using a vacuum pump 20 to evaporate the $AlCl_3$ component of the salt 12 into a cold condenser 22. Alternatively, the vacuum pump 20 and cold condenser 22 may be coupled to a conduit 23 that physically transports the salt bath 12 out of the vessel 18 at about 95-600 degrees C., or a drain pipe 25 is used to drop the salt bath 12 out of the vessel 14. The removal method of choice is then stopped and an inert gas supply 24, such as argon or helium, is used to purge the vessel 18. The vessel 18 is set to about 95-250 degrees C. and a salt powder feeder 26 drops a fresh batch of salt 12 into the vessel 18 with a composition such as 67-80 wt % $AlCl_3$, 8-17 wt % NaCl, 8-12 wt % KCl, and 4 wt % KBr (or KI, as both act as brighteners). This fresh salt mixture 12 becomes molten and a reducing current of no more than 7 mA/cm$^2$ is applied at the working electrode 28 and substrate 14 until a desired coating thickness of aluminum 32 from solution is obtained. Again, during this time, agitation of the salt bath 12 is performed using the mechanical or ultrasonic agitator 17 or the like. In addition, or alternatively, the substrate 14 may be rotated to induce forced convection in lieu of mechanical or ultrasonic agitation. Agitation of the salt bath 12 is preferred, but may not be necessary in all electrodeposition cases. Small amounts of transition metal halides may be added to the salt bath 12 to control the formation of aluminum alloys on the surface of the substrate 14. These metals may include, for example, Mn, Cr, and Ni. The concentrations of these metals may be in suitable ratios to form preferred alloys. The applied substrate voltage with respect to each alloy component and any mass transport, adsorption, or chloride speciation behavior will influence electrodeposition behavior. In one example, $MnCl_2$ may be added at low concentrations of ≤0.3 wt % to achieve co-electrodeposition with Al by applying a slight underpotential of −0.2 to −0.4 V vs. $Al^{3+/0}$. Again, it should be noted that the various electrodes 16,28 and a reference electrode 36 are all coupled to an appropriate potentiostat/power supply 38.

In a further exemplary embodiment using the Al coating set-up 10, a substrate 14 can be submerged in an aluminum halide organic solvent bath 12 in a vessel 18, such as a 55-67 wt % $AlCl_3$ and 33-45 wt % $C_6(H_{5-y},F_y)SO_2CF_3$ (e.g., trifluoromethylphenylsulfone, where y is a number from 0-5), which represents an anhydrous liquid that acts as a good protection layer for the surface of the substrate. In this case, an aluminum anode 28 is provided. A small (0.1-10) wt % of an ionic liquid chloride salt is added as a brightener. The brightener may be an ammonium or phosphonium halide (e.g., trihexyltetradecylphosphonium chloride ($P((CH_2)_5CH_3)_3(CH_2)_{13}CH_3Cl$)) or other organic chloride containing no easily ionizable hydrogen). As in previous embodiments, in part, the substrate is first anodically electropolished to remove surface oxides with a 10-30 mA/cm$^2$ current density followed by pulsed electrodeposition to induce intermetallic/alloy formation between Al and the substrate chemical species. Finally, a reducing current density of no more than 7 mA/cm$^2$ is applied at the substrate 14 to electrodeposit the aluminum, optionally at less than the flash point of the organic salt bath, for example, based on the level of control required for crystal growth. The substrate 14 is then washed with acetone, hexane, ethanol, methanol, or another suitable solvent to remove the salt 12. Again, annealing and a hot Al dip may be performed after this electroplating step.

Although the present disclosure is illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following non-limiting claims for all purposes.

What is claimed is:

1. A method for electropolishing a surface of an air and/or moisture sensitive substrate, the method comprising:

in a vessel, submerging the substrate in a first molten salt bath at a first temperature and applying an anodic current to the substrate to electropolish the surface of the substrate;

wherein the first molten salt bath comprises a first inorganic salt bath;

wherein, when used, the first inorganic salt bath comprises aluminum halide and alkali metal halide; and wherein, when used, the first inorganic salt bath comprises 76-100 wt % $AlI_3$, 0-15 wt % NaI, and 0-9 wt % KI at a first temperature of 110-250 degrees C.; and wherein the anodic current density is 10-30 $mA/cm^2$ applied using one of a reverse bias from a power supply coupled to the first molten salt bath and by swapping working and auxiliary electrode leads coupled to the first molten salt bath.

2. A method for electropolishing a surface of an air and/or moisture sensitive substrate, the method comprising:

in a vessel, submerging the substrate in a first molten salt bath at a first temperature and applying an anodic current to the substrate to electropolish the surface of the substrate;

wherein the first molten salt bath comprises a first inorganic salt bath;

wherein, when used, the first inorganic salt bath comprises aluminum halide and alkali metal halide; and wherein, when used, the first inorganic salt bath comprises 82 wt % $AlCl_3$, 11 wt % NaCl, and 7 wt % KCl; and wherein the anodic current density is 10-30 $mA/cm^2$ applied using one of a reverse bias from a power supply coupled to the first molten salt bath and by swapping working and auxiliary electrode leads coupled to the first molten salt bath.

3. The method of claim 1, further comprising, subsequent to electropolishing the surface of the substrate, coating the electropolished surface of the substrate with aluminum.

4. The method of claim 3, wherein coating the electropolished surface of the substrate with aluminum comprises:

discontinuing the anodic current and allowing the electropolished substrate to dwell in the first molten salt bath such that the electropolished surface of the substrate is coated with aluminum.

5. The method of claim 3, wherein coating the electropolished surface of the substrate with aluminum comprises:

one or more of heating the first molten salt bath and evaporating the first molten salt bath under vacuum to remove the first molten salt bath from the vessel, physically pumping the first molten salt bath from the vessel, and draining the first molten salt bath from the vessel; and in the vessel, submerging the electropolished substrate in a second molten salt bath at a second temperature such that the electropolished surface of the substrate is coated with aluminum;

wherein the second molten salt bath comprises one of a second organic salt bath and second inorganic salt bath;

wherein, when used, the second organic salt bath comprises one of (a) aluminum halide and ionic liquid (e.g., trihexyltetradecylphosphonium chloride ($P((CH_2)_5CH_3)_3(CH_2)_{13}CH_3Cl)$), (b) a combination of an aluminum halide and halogenatedmethylphenylsulfone ($C_6(H_{5-y},X_y)SO_2CX_3$, where y is a number from 0-5), (c) a combination of an aluminum halide, an ionic liquid (e.g., trihexyltetradecylphosphonium chloride ($P((CH_2)_5CH_3)_3(CH_2)_{13}CH_3Cl)$), and halogenatedmethylphenylsulfone ($C_6(H_{5-y},X_y)SO_2CX_3$, where y is a number from 0-5), and (d) $AlF_3$-organofluoride-hydrofluoric acid adduct; and wherein, when used, the second inorganic salt bath comprises aluminum halide and alkali metal halide.

6. The method of claim 5, wherein, the halogenatedmethylphenylsulfone comprises fluorinatedmethylphenylsulfone ($C_6(H_{5-y},F_y)SO_2CF_3$).

7. The method of claim 5, further comprising purging the vessel with an inert gas after the first molten salt bath is removed from the vessel.

8. The method of claim 5, wherein the second temperature is below a flash point of the second organic salt bath, when used, and 95-250 degrees C. for the second inorganic salt bath, when used.

9. The method of claim 5, wherein the second inorganic salt bath comprises 68-100 wt % $AlCl_3$, 0-19 wt % NaCl, and 0-13 wt % KCl.

10. The method of claim 3, wherein coating the electropolished surface of the substrate with aluminum further comprises:

applying a reducing current to the electropolished substrate to coat the surface of the electropolished substrate with aluminum derived from the first molten salt bath.

11. The method of claim 10, wherein the reducing current is no more than 7 $mA/cm^2$, is alternating-current frequency modulated, and is applied using a working electrode coupled to the first molten salt bath.

12. The method of claim 5, wherein coating the electropolished surface of the substrate with aluminum further comprises:

applying a reducing current to the electropolished substrate to coat the surface of the electropolished substrate with aluminum derived from the second molten salt bath.

13. The method of claim 12, wherein the reducing current is no more than 7 $mA/cm^2$, is alternating-current frequency modulated, and is applied in the second molten salt bath.

14. The method of claim 5, further comprising adding a transition metal halide to the second molten salt bath to cause an aluminum alloy to be coated on the surface of the electropolished substrate.

15. The method of claim 14, wherein the transition metal halide comprises one or more of Mn, Cr, and Ni.

16. The method of claim 3, further comprising annealing a resulting aluminum coating.

17. The method of claim 3, wherein coating the electropolished surface of the substrate with aluminum comprises:

in the vessel, submerging the substrate in a molten pool of aluminum to coat the surface of the substrate with aluminum or the surface of an aluminum-coated substrate with additional aluminum.

18. A method for coating aluminum on a surface of an air and/or moisture sensitive substrate, the method comprising:

in a vessel, submerging the substrate in a molten salt bath with a temperature of 95 degrees C. to 250 degrees C., wherein the molten salt bath comprises an inorganic salt bath comprising 76-100 wt % $AlI_3$, 0-15 wt % NaI, and 0-9 wt % KI;

applying an anodic current to the substrate to electropolish the surface of the substrate; and coating the electropolished surface of the substrate with aluminum by one of submerging the substrate in a molten pool of aluminum, discontinuing the anodic current and allowing the electropolished substrate to dwell in the molten salt bath at a temperature of 95 degrees C. to 250 degrees C. such that the electropolished surface of the substrate is electrolessly coated with aluminum, and applying a reducing current to the electropolished substrate to electroplate the surface of the electropolished substrate with aluminum derived from the molten salt bath, wherein the reducing current is no more than 7 $mA/cm^2$;

wherein the molten salt bath comprises aluminum halide and alkali metal halide.

19. The method of claim 18, wherein the substrate comprises one or more of zirconium, hafnium, thorium, uranium, plutonium, manganese, a rare earth metal (La—Lu), yttrium, magnesium, lithium, and their alloys.

20. The method of claim 18, wherein the vessel is sealed and contains an inert cover gas.

21. The method of claim 18, wherein the substrate electrolessly coated with aluminum is submerged in a molten pool of aluminum.

22. The method of claim 18, wherein the substrate electroplated with aluminum is submerged in a molten pool of aluminum.

* * * * *